US007637441B2

(12) United States Patent
Heinrich et al.

(10) Patent No.: US 7,637,441 B2
(45) Date of Patent: Dec. 29, 2009

(54) COLD GAS SPRAY GUN

(75) Inventors: Peter Heinrich, Germering (DE); Heinrich Kreye, Hamburg (DE); Tobias Schmidt, Eslohe (DE); Peter Richter, Heldenstein (DE)

(73) Assignee: Linde Aktiengesellschaft, Wiesbaden (DE)

( * ) Notice: Subject to any disclaimer, the term of this patent is extended or adjusted under 35 U.S.C. 154(b) by 446 days.

(21) Appl. No.: 11/478,031

(22) Filed: Jun. 29, 2006

(65) Prior Publication Data

US 2007/0221746 A1 Sep. 27, 2007

(30) Foreign Application Priority Data

Mar. 24, 2006 (DE) ..... 10 2006 014 124

(51) Int. Cl.

| | |
|---|---|
| ***B05B 1/24*** | (2006.01) |
| ***B05B 7/16*** | (2006.01) |
| ***B05B 7/14*** | (2006.01) |
| ***B05B 7/04*** | (2006.01) |
| ***B05B 7/00*** | (2006.01) |
| ***B05B 1/06*** | (2006.01) |
| ***B05C 19/00*** | (2006.01) |

(52) U.S. Cl. ..... 239/135; 239/79; 239/434.5; 239/591; 239/594

(58) Field of Classification Search ..... 239/8, 239/13, 79, 85, 128, 135, 139, 398, 416.5, 239/427, 433, 434, 434.5, 589, 591, 594; 118/302, 308, 715; 427/191, 192, 421.1
See application file for complete search history.

(56) References Cited

U.S. PATENT DOCUMENTS

| | | | | |
|---|---|---|---|---|
| 6,623,796 | B1 | 9/2003 | Van Steenkiste | |
| 2002/0033135 | A1 * | 3/2002 | Kay et al. | 118/715 |
| 2003/0219542 | A1 * | 11/2003 | Ewasyshyn et al. | 427/421 |
| 2004/0018317 | A1 * | 1/2004 | Heinrich et al. | 427/446 |
| 2007/0074656 | A1 * | 4/2007 | Zhao et al. | 118/308 |

FOREIGN PATENT DOCUMENTS

| | | |
|---|---|---|
| DE | 10 2005 004 116 | 4/2006 |
| DE | 10 2005 004 117 | 4/2006 |
| DE | 10 2005 053 731 A1 | 5/2007 |

* cited by examiner

*Primary Examiner*—Darren W Gorman
(74) *Attorney, Agent, or Firm*—Crowell & Moring LLP

(57) ABSTRACT

A cold gas spray gun is disclosed. The spray gun includes a high-pressure gas heater which has a pressure vessel through which gas flows and a heating element situated in the pressure vessel, as well as a mixing chamber in which particles can be admixed with the gas through a particle feed. A Laval nozzle is arranged downstream in the direction of flow of the gas and consists of a convergent section, a nozzle throat and a divergent section. The high-pressure gas heater and/or the mixing chamber is/are at least partially insulated on the inside in the areas of contact with the gas.

14 Claims, 2 Drawing Sheets

COLD GAS SPRAY GUN

This application claims the priority of German Patent Document No. 10 2006 014 124.5, filed Mar. 24, 2006, the disclosure of which is expressly incorporated by reference herein.

BACKGROUND AND SUMMARY OF THE INVENTION

The invention relates to a device for cold gas spraying. The invention relates in particular to a cold gas spray gun, a device having such a cold gas spray gun and a method using an inventive cold gas spray gun.

In cold gas spraying or kinetic spraying, powder particles of 1 μm to 250 μm are accelerated to velocities of 200 m/s to 1600 m/s in a gas stream without melting or fusing, and are sprayed onto the surface to be coated, i.e., the substrate. Only on impact with the surface does the temperature at the colliding interfaces rise due to plastic deformation with very high strain rates, leading to welding of the powder material to the substrate and among the particles. To do so, however, a minimum impact velocity, the so-called critical velocity, must be exceeded. The mechanism and quality of the welding are comparable to those in explosive welding. By heating the process gas, the velocity of the gas and thus the velocity of flow of the gas in the nozzle, and therefore also the particle velocity on impact, are increased. The gas may be accelerated to supersonic velocity in a Laval nozzle, for example, a nozzle that first converges to form a nozzle throat and then diverges, with the powder material being injected into the gas stream upstream or downstream from the nozzle throat and accelerated toward the substrate.

The particle temperature on impact increases with the process gas temperature. This results in thermal softening and ductilization of the powder material and lowers the critical velocity of the impacting particles. Since the velocity also increases, both the particle velocity and the particle temperature on impact are increased by raising the process gas temperature. Both of these have a positive effect on the application efficiency and layer quality. The process gas temperature then always remains below the melting point of the powder material used for spraying. In cold gas spraying, a "colder" gas is thus used in comparison with other spraying methods in which the powder particles are melted by the gas. As in spray methods in which adjunct materials are melted by hot gas, the gas must also be heated in cold gas spraying.

To be able to greatly accelerate powder particles, in particular larger particles between 25 and 100 μm in size, gas at a high pressure is required. To do so, the components of an apparatus for cold gas spraying must accordingly be designed to be pressure-proof. Most systems for stationary operation are designed for 30 bar, with the individual modules being designed for a required prepressure of approx. 35 bar. Some types of systems are designed only for pressures of 15 bar and/or for pressures of up to 7 bar. If the pressure is to be increased further, as desired, and the high temperature can act directly on the material of the contact surfaces of the components, this necessitates the use of expensive high-temperature materials that are difficult to process, or the component, in particular a spray gun, becomes relative heavy due to its size and the required wall thicknesses. Furthermore, the dissipation of heat over the contact surface results in losses and an unwanted drop in the gas temperature, in particular upstream from the nozzle throat of the Laval nozzle.

U.S. Pat. No. 6,623,796 B1 describes a spray gun having a Laval-type nozzle consisting of an inlet cone and an exit cone which abut against one another at the nozzle throat. The Laval nozzle receives air under high pressure from an air heater and a mixing chamber where an air-powder mixture is admixed. The powder is accelerated through the Laval nozzle as a supersonic nozzle and is heated without melting by the air heated in the air heater.

One disadvantage of this related art is that the strength and thickness of the material of the components of the spray gun must be designed to be very high to be able to withstand the high pressure at high temperatures of the material because the strength of the material declines greatly with temperature.

German Patent Document No. DE 102005004116, which was published subsequently, discloses a cold gas spray gun having a nozzle for acceleration of a gas jet and particles, the nozzle being divided into a convergently tapering nozzle section and a nozzle outlet developing into another at the nozzle throat, and having an injection tube that ends more than 40 mm in front of the nozzle throat.

German Patent Document No. DE 102005004117, which was published subsequently, discloses a device for cold gas spraying using a spray gun having a nozzle and a heater for heating the gas, the heater for heating the gas being divided into at least two heaters and an after-heater, mounted directly on the spray gun, while a second, free-standing preheater is connected by a line to the spray gun.

German Patent Document No. DE 102005053731, which was published subsequently, discloses a device for high-pressure gas heating using a pressure vessel through which gas flows, with a heating element situated in the pressure vessel and insulation. The insulation is provided on the inside wall of the pressure vessel and means are provided for the dissipation of heat in the pressure vessel, so the pressure vessel has a lower temperature than the heated gas.

Therefore, the object of the present invention is to make available a device for cold gas spraying, in particular a spray gun which can be operated with gas at high temperatures and pressures, but nevertheless has a low weight and a spray gun that is easy to handle.

The usable process gas pressure can be increased to significantly more than 35 bar to advantage with the inventive cold spray gun without excessively increasing the weight of the cold gas spray gun, due to thick walls and thick material. The components under pressure load can be operated at much lower temperatures, thus with a greater material strength, due to the internal insulation of the high-pressure gas heater and/or mixing chamber as well as the Laval nozzle. Unnecessary thermal losses to the environment are also prevented by the insulation, with the cost of heating the gas lower. Finally, this also results in a lower inertia of the cold gas spray gun when starting operation because the relatively large masses of wall material need not be heated and service life is increased due to the lower temperature burden on the materials. An increase in the process gas pressure and an increase in the gas density cooperate particularly advantageously with an increase in the process gas temperature and the use of larger particles to influence the quality of the coating, which are possible only due to the internal insulation. Despite the high process gas pressure and process gas temperatures, high efficiency can be achieved in spraying, and the disadvantages of a low gas density and smaller cross-sections are avoided. In the absence of insulation, these problems occur with a reduction in size of the cold gas spray gun. This reduction would be necessary to maintain weight limits with the required thickness of materials.

In an advantageous embodiment, the pressure vessel of the high-pressure gas heater and/or the mixing chamber is/are lined with insulation made of solid or flexible ceramic insulation materials.

The pressure vessel of the high-pressure gas heater and/or the mixing chamber is advantageously insulated by a gas gap between an inner shell enclosing the gas and an outer shell.

The high-pressure gas heater, mixing chamber and Laval nozzle are advantageously aligned linearly and concentrically with one another.

An angled introduction of gas into the available spray guns results in a non-uniform thermal burden, the deformation of components, and thermally induced stresses, which would very rapidly result in damage to the gun at the high gas temperatures required here. This is prevented by a linear gas guidance.

The direction of the flow of gas between the high pressure gas heater and the mixing chamber may be diverted by an angle of up to 60° between them.

If the flow guidance in the area of two-phase flow of particle feed is continuous and free of edges, then the risk of deposition of particles is reduced. A more compact design of the cold gas spray gun can be achieved by a deflection of up to 60° upstream from the mixing chamber.

In an advantageous embodiment, the mixing chamber is also the convergent section of the Laval nozzle.

The convergent section of the Laval nozzle advantageously has a length between 50 mm and 250 mm and has a conical, concave, or convex internal contour.

In an advantageous embodiment, the convergent nozzle section is insulated from the inside or is made entirely of insulating material, in particular a ceramic.

In an advantageous embodiment, the pressure vessel and/or the mixing chamber and/or the convergent section and/or the divergent section may be made entirely or partially of titanium or aluminum as well as alloys thereof.

By using titanium as a construction material, the spray gun may be designed to be especially light; likewise with the use of aluminum. The latter is especially inexpensive as a construction material for the cold gas spray gun.

In an advantageous embodiment, the distance between the particle feed in the mixing chamber and the nozzle throat may amount to 40 mm to 400 mm, preferably 100 mm to 250 mm.

Depending on the velocity of flow of the process gas, heating of the particles can be achieved due to a sufficiently long dwell time of the particles in the heated gas.

The flow cross-section of the mixing chamber and/or the convergent section may advantageously be between 5 times and 50 times the cross-sectional area of the nozzle throat, preferably between 8 times and 30 times, especially preferably between 10 times and 25 times, on at least 70% of the distance from the particle feed to the nozzle throat.

Therefore, the velocity flow in the area between the particle feed and the nozzle throat is not too low to maintain two-phase flow of gas and particles. This prevents particle agglomerates and deposits on walls, which could cause sensitive interference in operation of the cold gas spray gun, for example, in the case of blockage of the nozzle.

In an advantageous embodiment, the nozzle throat has a diameter of between 2 mm and 4 mm; the divergent section has a length corresponding to 30 to 90 times the diameter of the nozzle throat; the area ratio of the cross-section at the end of the divergent section to that of the nozzle throat cross-section is between 3 and 15; and the inside contour is conical, convex or concave.

The gas is advantageously supplied at a pressure of 15 to 100 bar, preferably 20 to 60 bar, especially preferably from 25 to 45 bar, and at a volume throughput of 30 to 600 $m^3/h$.

Larger particles can therefore be accelerated to the required velocities.

The particle feed may consist of a tube fed laterally at any angle or one or more bores at the end of the high-pressure gas heater or in the mixing chamber.

The heating output of the heating element, based on the flow cross-section in the nozzle throat, is 1.5 to 7.5 $kW/mm^2$, preferably 2 to 4 $kW/mm^2$.

The output of the heating element per unit of volume may be from 10 to 40 $MW/m^3$, preferably 20 to 30 $MW/m^3$.

This permits a compact design.

The spray gun can receive the gas through a plastic tube, in particular made of Teflon®, which is connected to a second high-pressure gas heater, preheated to 230° C., or through a hot gas metal tube preheated to 700° C.

In an advantageous embodiment, the total heating output of the high-pressure gas heater and the second high-pressure gas heater, based on the flow cross-section in the nozzle throat, is 4 to 16 $kW/mm^2$, preferably 5 to 9 $kW/mm^2$.

In an inventive method, downstream from the high-pressure gas heater, the gas may be supplied to the mixing chamber at temperatures greater than 600° C., preferably greater than 800° C., especially preferably greater than 1000° C.

More than 80 percent, by weight, of the particles in the nozzle throat supplied to the mixing chamber advantageously achieve 70% of the gas temperature in the nozzle throat, measured in Kelvin.

This ensures adequate quality of the coating being formed because an adequate amount of particles will have the energy required to form a layer on impact.

A mixture of particles whose mass consists of at least 80% particles with a grain size between 5 and 150 μm, preferably between 10 and 75 μm and especially preferably between 15 and 50 μm may advantageously be used.

With the inventive cold gas spray gun and the inventive method, the impact temperature of larger particles (greater than 15 μm) can be increased significantly by efficient preheating of the particles in a hot gas process stream. Such larger particles do not lose temperature as rapidly in the expanding gas jet of the nozzle and it is less problematical and less expensive to use high quality and precisely specified powders consisting of particles in larger fractions (−38+11 μm; −45+15 μm; −75+25 μm; −105+45 μm). Handling and conveyance in spraying are definitely simpler than with the conventional powder fractions with −22 μm and −25+5 μm.

BRIEF DESCRIPTION OF THE DRAWINGS

An advantageous exemplary embodiment of the inventive device for high-pressure gas heating is explained in greater detail on the basis of the accompanying drawings, in which.

DETAILED DESCRIPTION OF THE DRAWINGS

Figure 1:
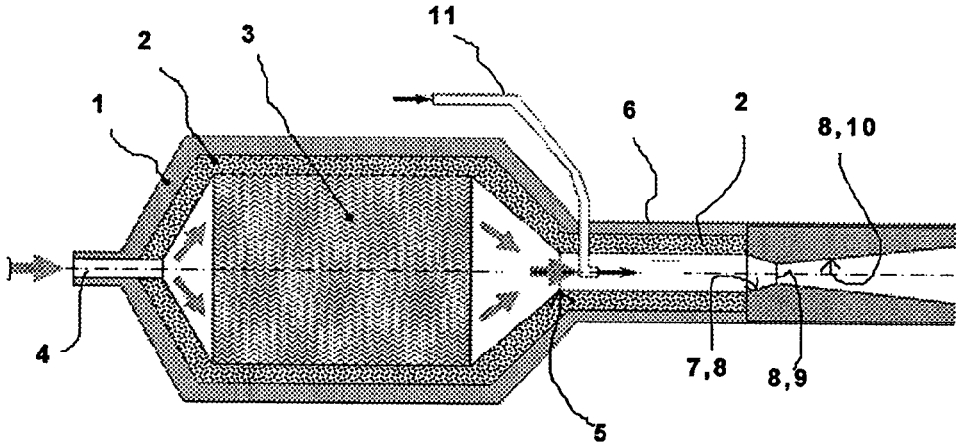
FIG. 1 shows schematically an exemplary embodiment of an inventive cold gas spray gun in a longitudinal section.

FIG. 1 shows schematically an advantageous exemplary embodiment of the inventive cold gas spray gun in a longitudinal section. A pressure vessel 1 has an insulation 2 on its inside. In the interior of the pressure vessel 1 there is heating element 3, here in the form of a filament heater, consisting of a plurality of electric heating wires. The gas to be heated is supplied to the pressure vessel 1 through a gas feed line 4. In the present example, the pressure vessel 1 is a rotationally symmetrical body. A gas outlet 5 directs the heated or further heated gas into a mixing chamber 6 to which the convergent section 7 of a Laval nozzle 8 is connected. The Laval nozzle 8 also consists of a nozzle throat 9 and a divergent section 10. A particle tube 11 can supply particles to the mixing chamber 6. The mouth of the particle tube 11 is aligned with the developing gas stream.

The gas flows through the pressure vessel 1 and the mixing chamber 6 and Laval nozzle 8, which are aligned linearly with the pressure vessel, as indicated by the arrows, with the gas being distributed uniformly over the cross-section of the heating element 3. The insulation 2 mounted on the inside achieves the effect that only a small amount of thermal energy reaches the wall of the pressure vessel 1 and the mixing chamber 6. Since the pressure vessel 1 and the mixing chamber 6 emit heat into the environment at the same time, the temperature established at the pressure vessel 1 and the mixing chamber 6 is considerably lower than the temperature of the heated gas. The pressure vessel 1 and the mixing chamber 6 may therefore be designed to be relatively light and thin-walled. The particles to be sprayed are admixed with the heated gas through the particle tube 11 in the mixing chamber 6. This is done by conveying the particles through the particle tube by means of a carrier gas stream. On the path between the particle injection and the narrowest cross-section of the Laval nozzle 8, i.e., the nozzle throat 9, the particles are heated, with more than 80 percent by weight of the particles in the nozzle throat reaching 0.7 times the temperature in Kelvin of the gas stream at this location. In the present exemplary embodiment, this path is between 40 and 400 mm long, preferably between 100 and 250 mm, depending on the particles and gases used. An early particle injection cooperates with the use of larger particles and higher gas temperatures to have an especially great effect on the quality and efficiency of the coating. This results in a very definite increase in the impact temperature of particles.

In the divergent section 10 of the Laval nozzle 8, the expanding gas is accelerated to supersonic velocity. The particles are greatly accelerated in this supersonic flow, reaching velocities of between 200 m/s and 1500 m/s. The lengthening of the divergent nozzle section 10 together with a possible increase in temperature and the pressure of the gas according to this invention have a particularly great effect. Effective use of elongated divergent nozzle section 10 here requires a high enthalpy of the gas. Advantageous lengths of the divergent nozzle section 10 are 100 mm or more, preferably 100 to 300 mm, especially preferably 150 to 250 mm.

A uniform flow through the heating element is ensured by the fact that the cross-sectional area of the heating cartridge is no greater than 1500 times, preferably no greater than 1000 times, the area of the flow cross-section in the nozzle throat 9. Such a cold gas spray gun is characterized by a compact design and a high power density. The ratio of length to diameter is between 3 and 6. The power density of the cold gas spray gun, the quotient of heating output to total weight, is between 1 and 8 kW/kg with a range between 2 kW/kg and 4 kW/kg that can be implemented well. Heating element 3 has an output per unit of volume of from 10 to 40 $MW/m^3$. Therefore, gas temperatures of 400° C. to 700° C. in the gas feed line are allowed. This temperature can be achieved by a second stationary preheating, which is connected to the cold gas spray gun by a tube. If a metal hot gas tube is used, then 700° C. is possible.

Figure 2:
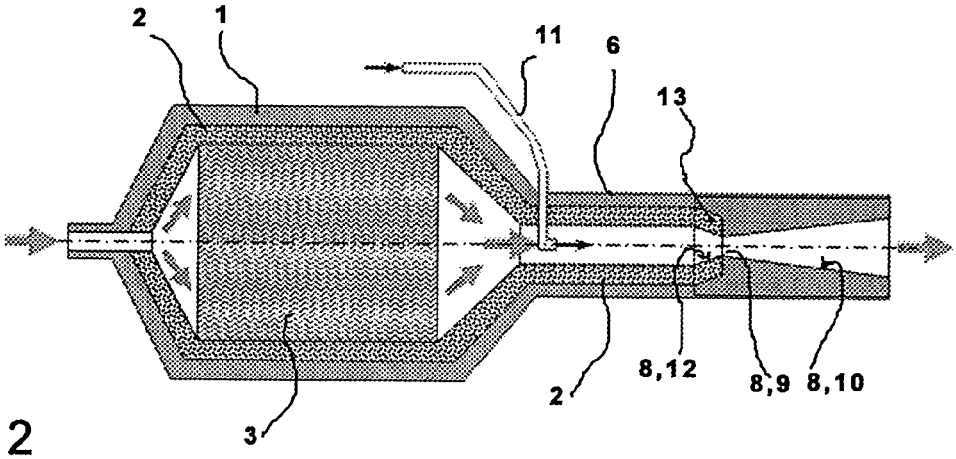
FIG. 2 shows schematically another exemplary embodiment of an inventive cold gas spray gun in a longitudinal section.

FIG. 2 shows schematically another embodiment of an inventive cold gas spray gun in a longitudinal section. The same parts are labeled with the same reference numerals. The pressure vessel 1 and mixing chamber 6 have insulation 2 on the inside. Heating element 3 is arranged in the interior of pressure vessel 1. A convergent section 12 of Laval nozzle 8 is connected to mixing chamber 6 and also includes nozzle throat 9 and divergent section 10. Particle tube 11 can supply particles to mixing chamber 6. Convergent section 12 also has insulation 13.

This prevents any thermal losses or thermal burden on the nozzle.

Figure 3:
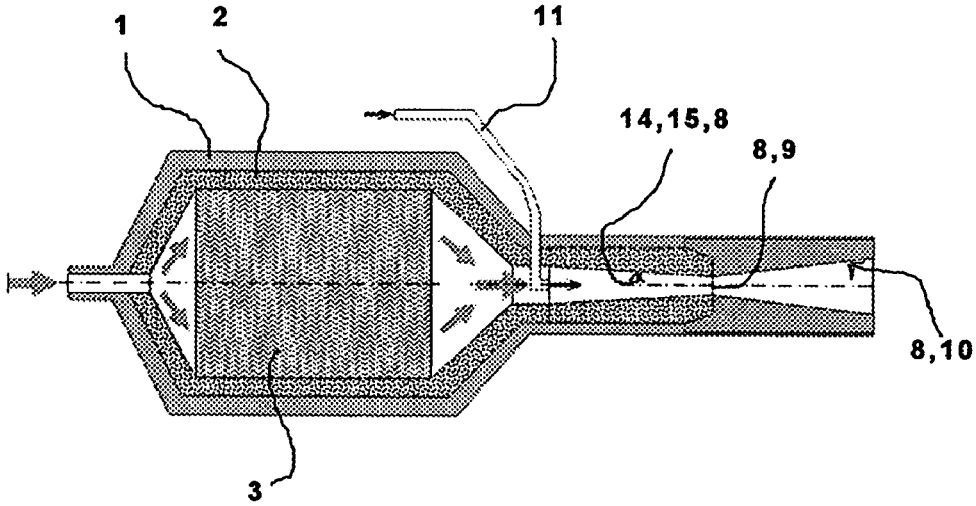
FIG. 3 shows schematically another exemplary embodiment of an inventive cold gas spray in a longitudinal section.

FIG. 3 shows schematically a third exemplary embodiment of an inventive cold gas spray gun in longitudinal section. The same components are again labeled with the same reference numerals. Pressure vessel 1 has insulation 2 on its inside and heating element 3 is arranged in its interior. Mixing chamber 14 is also convergent section 15 of Laval nozzle 8 which also comprises nozzle throat 9 and divergent section 10. Particle tube 11 can supply particles to mixing chamber 14. Convergent section 15 and/or mixing chamber 14 also have/has insulation 2 and a length of between 50 and 250 mm. This a simpler design of the cold gas spray gun.

LIST OF REFERENCE NUMERALS

1 Pressure vessel
2 Insulation
3 Heating element
4 Gas feed line
5 Gas outlet
6 Mixing chamber
7 Convergent section
8 Laval nozzle
9 Nozzle throat
10 Divergent section
11 Particle tube
12 Convergent section
13 Insulation
14 Mixing chamber
15 Convergent section The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cold gas spray gun, comprising:

a high-pressure gas heater with a pressure vessel through which a gas flows and a heating element situated in the pressure vessel;

a mixing chamber in which particles are supplied to the gas through a particle feed; and a Laval nozzle consisting of a convergent section, a nozzle throat, and a divergent section;

wherein the high-pressure gas heater, the mixing chamber, and the Laval nozzle are arranged in succession in a direction of flow of the gas in the cold gas spray gun and wherein the high-pressure gas heater and the mixing chamber are at least partially insulated on an inside in an area of contact with the gas.

2. The cold gas spray gun as claimed in claim 1, wherein the pressure vessel of the high-pressure gas heater and/or the mixing chamber is/are lined with an insulation consisting of solid or flexible ceramic insulation material.

3. The cold gas spray gun as claimed in claim 1, wherein the high-pressure gas heater, the mixing chamber and the Laval nozzle are aligned linearly and concentrically with one another.

4. The cold gas spray gun as claimed in claim 1, wherein the direction of flow of the gas between the high-pressure gas heater and the mixing chamber is deflected by an angle of up to 60 ° in relation to one another.

5. The cold gas spray gun as claimed in claim 1, wherein the mixing chamber forms the convergent section of the Laval nozzle.

6. The cold gas spray gun as claimed in claim 1, wherein the convergent section of the Laval nozzle has a length between 50 and 250 mm and a conical, inside contour.

7. The cold gas spray gun as claimed in claim 1, wherein the convergent nozzle section is insulated on an inside of the convergent nozzle or is made entirely of an insulating material.

8. The cold gas spray gun as claimed in claim 1, wherein the pressure vessel and/or the mixing chamber and/or the convergent section and/or the divergent section is/are made entirely or partially of titanium, aluminum, or alloys thereof.

9. The cold gas spray gun as claimed in claim 1, wherein a distance between a particle feed in the mixing chamber and the nozzle throat amounts to 40 mm to 400 mm.

10. The cold gas spray gun as claimed in claim 9, wherein for at least 70% of the distance from the particle feed to the nozzle throat, a flow cross-section of the mixing chamber and/or the convergent section amounts to between 5 times and 50 times a nozzle throat cross-sectional area.

11. The cold gas spray gun as claimed in claim 1, wherein the nozzle throat has a diameter of between 2 and 4 mm, the divergent section has a length corresponding to 30 to 90 times the diameter of the nozzle throat and an area ratio of a cross-section at an end of the divergent section to that of a nozzle throat cross-section is between 3 and 15.

12. The cold gas spray gun as claimed in claim 1, wherein a particle feed consists of a tube supplied laterally at any angle.

13. The cold gas spray gun as claimed in claim 1, wherein a heating power of the heating element, based on a flow cross-section in the nozzle throat, amounts to 1.5 to 7.5 $kW/mm^2$.

14. The cold gas spray gun as claimed in claim 1, wherein a power per unit of volume of the heating element amounts to 10 to 40 $MW/m^3$.

* * * * *

UNITED STATES PATENT AND TRADEMARK OFFICE

CERTIFICATE OF CORRECTION

PATENT NO. : 7,637,441 B2
APPLICATION NO. : 11/478031
DATED : December 29, 2009
INVENTOR(S) : Heinrich et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 629 days.

Signed and Sealed this

Twenty-first Day of December, 2010

David J. Kappos

David J. Kappos
*Director of the United States Patent and Trademark Office*